United States Patent [19]

Sdunek

[11] Patent Number: 4,937,548

[45] Date of Patent: Jun. 26, 1990

[54] CIRCUIT BREAKER

[75] Inventor: Bruce C. Sdunek, Howell, Mich.

[73] Assignee: Mechanical Products, Inc., Jackson, Mich.

[21] Appl. No.: 426,415

[22] Filed: Oct. 25, 1989

[51] Int. Cl.[5] ..... H01H 71/16

[52] U.S. Cl. ..... 337/70; 337/66; 337/74

[58] Field of Search ..... 337/70, 71, 72, 73, 337/74, 75, 66

[56] References Cited

U.S. PATENT DOCUMENTS 2,362,850 11/1944 Platz .

3,932,829 1/1976 Ellenberger ..... 337/75

4,167,720 9/1979 Krasser ..... 337/60

4,258,349 3/1981 Flory ..... 337/46

*Primary Examiner*—H. Broome

*Attorney, Agent, or Firm*—Beaman & Beaman

[57] ABSTRACT

A circuit breaker characterized by its ability to qualify for controlling high electrical capacity in a concise configuration employing two sets of contacts separated by a dielectric barrier having anti-arcing features to minimize arcing in a minimal size circuit breaker. Control of the contact movement is through a pivoted actuator and over-center linkage in conjunction with a bell crank lever operating a spring mounted contact moving through a short radius.

11 Claims, 4 Drawing Sheets

CIRCUIT BREAKER

BACKGROUND OF THE INVENTION

Resetable circuit breakers are widely used in electrical circuits to prevent current overloads, and in many applications it is desireable that the circuit breaker be as small as possible. A number of designs and configurations of small or mini circuit breakers have been proposed and such breakers utilize a wide variety of operating mechanisms. Typical circuit breakers of the afore described type are shown in U.S. Pat. Nos. 2,362,850; 3,932,829; 4,167,720 and 4,258,349.

Known small circuit breakers, necessarily, require that the electrical contacts be relatively close to each other, and it is common for these circuit breakers to utilize a pair of sets of contacts to provide multiple conductor protection, and the proximity of the contacts may permit arcing between opening contacts if means are not present to prevent such occurrences. For instance, it is very difficult for small circuit breakers to meet the requirements of Underwriter Laboratory's 1077 class A standards with respect to spacing between conductors to resist arcing. With small circuit breakers "creepage", i.e. the tendency for arcing across carbon deposits, and "clearance", i.e. the noninsulated spacing between conductors, are difficult to control due to dimensional limitations.

It is an object of the invention to provide a circuit breaker of concise configuration which is manually operable between open and closed circuit conditions and meets the Underwriter Laboratory's 1077 class A standards including those with respect to creepage and clearance.

A further object of the invention is to provide a concise circuit breaker utilizing a maunally operated actuator wherein the contact control mechanism employs an over-center linkage in conjunction with a bell crank lever to provide a positive operation of the position of the movable contacts of the circuit breaker.

An additional object of the invention is to provide a concise circuit breaker using a thermal actuator to sense excess current conditions wherein the circuit breaker employs a leaf spring mounted movable contact, and the movable contact sufficiently separates from its fixed contact to minimize arcing, even if the actuator is maintained in the closed position.

Another object of the invention is to provide a concise circuit breaker utilizing a pair of sets of movable and fixed contacts wherein the circuit breaker employs an insulated barrier between conductors, thermal actuators and the sets of contacts and arc creepage path extenders are employed to minimize arcing during contact separation and when the circuit breaker is in the open condition.

Yet another object of the invention is to provide a circuit breaker of concise configuration wherein the operating components are so configured, assembled and supported within the circuit breaker housing as to ensure consistent operation, simplify assembly, maximize the efficiency of component operation and meet Underwriter Laboratory's requirements and specifications.

An additional object of the invention is to provide a concise circuit breaker wherein selected moving components are formed of self-lubricating materials obviating the necessity to apply separate lubricants.

In the practice of the invention a concise circuit breaker in accord with the inventive concepts includes a synthetic plastic outer housing of a substantially rectangular configuration having an access side which will face outwardly when the circuit breaker is installed, and the inner side includes a plurality of terminals for connection to the circuit being controlled. Deflectable retaining fingers are defined on the exterior of the outer housing for maintaining the housing within a "snap-in" opening.

The circuit breaker inner housing is provided with a manually operated pivotal actuator on its access side which may be pivoted between circuit open and closed positions. An over-center linkage is pivotally mounted upon the actuator, and a bell crank lever spring operator is, in turn, mounted on the over-center linkage which transfers the mechanical movement of the actuator to a spring biased contact mounted upon the free end of a leaf spring whereby the movement of the actuator is transfered to the leaf spring for moving the leaf spring's contact into engagement with a fixed contact to close the controlled circuit.

The amount of current flowing through the circuit breaker conductors is monitered by a thermal actuator in the form of a combination bimetal and electrical resistance member wherein excessive current causes the bimetal actutor to be displaced, and such displacement is sensed by a lock lever which controls the position of the bell crank spring operator. Hence, when excessive current causes the thermal actuator to operate the lock lever the lock lever releases the bell crank operator to permit the electrical contacts to separate. Such contact separation occurs under excessive current conditions regardless of the position of the manually operated circuit breaker actuator.

The pivot axes of the manual actuator, over-center linkage and bell crank operator are parallel, and as stops defined on the housing limit the movement of the manual actuator between its circuit open and circuit closed conditions movement of the manual actuator from the circuit open to the circuit closed position causes the axis which pivotally mounts the over-center linkage to the manual actuator to pass through the plane containing the axes of the pivots of the manual actuator and bell crank contact spring operator thereby locking the three components in the "circuit closed" condition.

Preferably, the circuit breaker includes two sets of fixed and movable contacts whereby two circuits are simultaneously controlled by the manual actuator. The contact sets are separated by a dielectric barrier extending through the housing midway between its largest sides and each contact set is located on a opposite side of the barrier. Anti-arcing and anti-creep configurations are defined in the barrier sides adjacent the contacts, and openings defined in the barrier to receive operating components are configured to minimize arcing through the barrier.

Arcing is also minimized by utilizing a "short" leaf spring for supporting the movable contact of each set whereby the entire length of the leaf spring pairs is separated by the dielectric barrier. The contact leaf spring is of a generally U-configuration and includes a short leg which is attached to the contact arm terminal extension, and a long leg having a free end upon which the movable contact is mounted. The base interconnecting the legs is of an arcuate configuration to minimize localized spring flex stress, and the length of the spring long leg is, preferably, about one half, or less, the dimension of the housing transverse to the length of the manual actutor, over-center linkage and bell crank operator axes. This "short" length of the leaf spring upon which the movable contact is mounted permits the leaf spring and contact to be separated from the other leaf spring and contact throughout their entire configuration by the dielectric barrier and barrier openings are not adjacent the contact opening as might permit "arc over".

The long leg of the contact leaf spring is engaged by the bell crank operator and the use of the bell crank and the "short" contact supporting leaf spring permits full separation or opening of the contacts in the "trip free" mode even if the manual actuator is held in the "closed" condition.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
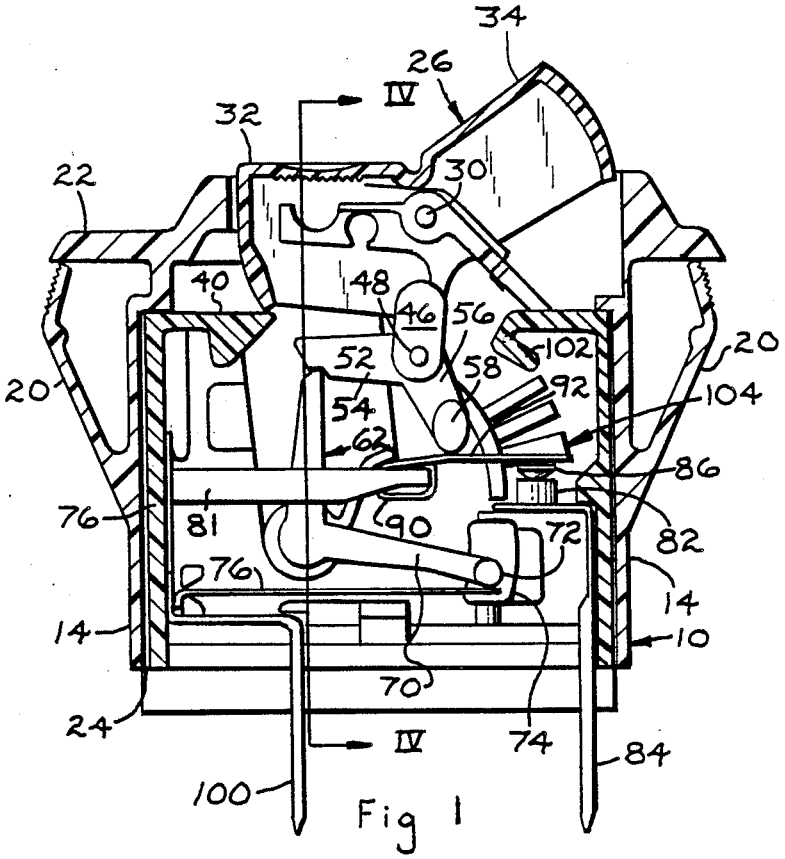
FIG. 1 is an elevational sectional view of a circuit breaker in accord with the invention illustrating the contacts in the closed condition as taken along Section I—I of FIG. 4.

The circuit breaker of the invention includes an outer housing generally indicated at 10 consisting of parallel spaced side walls 12, and spaced end walls 14. The sides and end walls define a rectangular configuration, and the inner end of the housing defined by the walls is open for receiving the inner housing generally indicated at 16. The outermost side of the housing 10 is designated the access side 18 and includes an opening for receiving the manual actuator as will be later described.

Externally, the housing 10 is provided with a pair of resilient, deflectable retaining fingers 20 which are formed during the molding of the housing and include serrated portions for engaging the edges of the rectangular opening in a circuit box or panel in which the circuit breaker is normally mounted, not shown. Upon the housing 10 being inserted into the panel opening, not shown, the retaining fingers 20 will momentarily be deflected inwardly and then snap outwardly to engage the opening edges and maintain the housing face plate 22 flush with the panel cover. This type of circuit breaker retention is well known in the art as conventionally employed.

The inner housing 16 is inserted into the outer housing through the inner open end 24 and the operating components for the circuit breaker are mounted thereon. These components include the manual circuit breaker actuator 26 pivotally mounted upon the inner housing barrier wall 28 by the pivot pin 30, and as will be appreciated from the drawings the actuator is of an inverted U cross section having finger engaging surfaces 32 and 34 defined thereon, the surface 32 being depressed to pivot the actuator 26 to the circuit breaker closed condition, and depressing of the surface 34 pivots the actuator to the circuit open position wherein the contacts are separated. A weak spring 35 bias actuator 26 counterclockwise, FIG. 2. The housing includes stop surfaces, such as at 36 and 40, FIG. 5, wherein, with reference to FIG. 5, engagement of the actuator 26 with the surface 36 limits rotation of the actuator in the circuit breaker open condition, and engagement of the actuator with the surface 40 limits actuator pivoting in the circuit closed direction.

Figure 3:
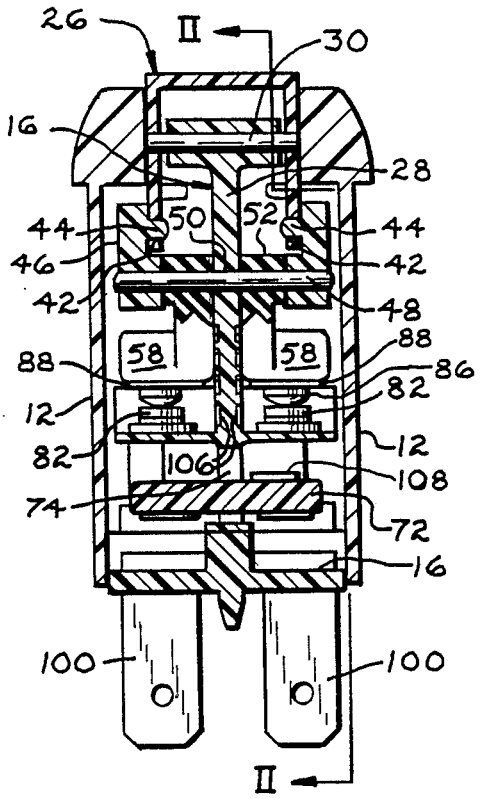
FIG. 3 is an elevational sectional view as taken along Section III—III of FIG. 2.

The sides of the actuator 26 are provided with aligned holes 42 for receiving the studs 44 of over-center links which define a pivot axis. As best illustrated in FIG. 3, the inner housing 16 includes the dielectric synthetic plastic barrier wall 28, and identical over-center links 46 are mounted upon opposite sides of the barrier, and as will be later described a number of the components of the invention are in duplicate having identical equivalents located upon opposite sides of the barrier wall.

It will therefore be appreciated that at their "upper" end as represented in FIG. 1, the links 46 are pivotally mounted to the actuator 26, and the lower portion of the over-center links include a bore for receiving the pivot pin 48 which extends through an opening 50 defined in the barrier wall 28.

A bell crank contact spring operator 52 is pivotally mounted upon the pin 48, an operator being mounted upon each side of the barrier 28, and the bell crank operators each include an arm 54 for engaging the lock lever, and an arm 56 having a transversely disposed head 58 for engaging the associated movable contact spring, as later described. The arms 54 and 56 are angularly related to each other approximately 120 degrees, and this angular relationship contributes to the concise configuration of the circuit breaker.

As will be appreciated from FIGS. 1 and 5, the outer end of the bell crank operator arm 54 is provided with a notch 60 for receiving the end of an arm of the lock lever, described below, and the head 58 formed on the arm 56 is of a convex configuration, FIG. 1, so as to engage the movable contact leaf spring substantially across its width, as will be apparent from FIG. 3.

Figure 4:
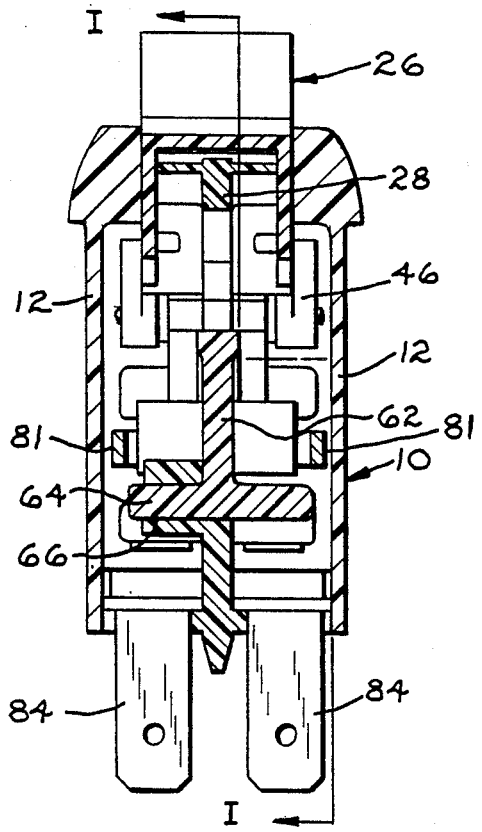
FIG. 4 is an elevational sectional view as taken along Section IV—IV of FIG. 1.

A lock lever 62 is pivotally mounted upon the inner housing 16 by its cylindrical pivot shaft 64, FIG. 4, being rotatably received within the inner housing bore 66. The lock lever includes an arm 68 which extends toward the manual actuator 26 having a relatively flat end for selectively engaging the bell crank notch 60. The lock lever also includes an arm 70 having a transverse head 72 which extends through the arcuate opening 74 defined in the barrier wall 28 which is engaged by the free end of the thermal actuators as later described.

Figure 7:
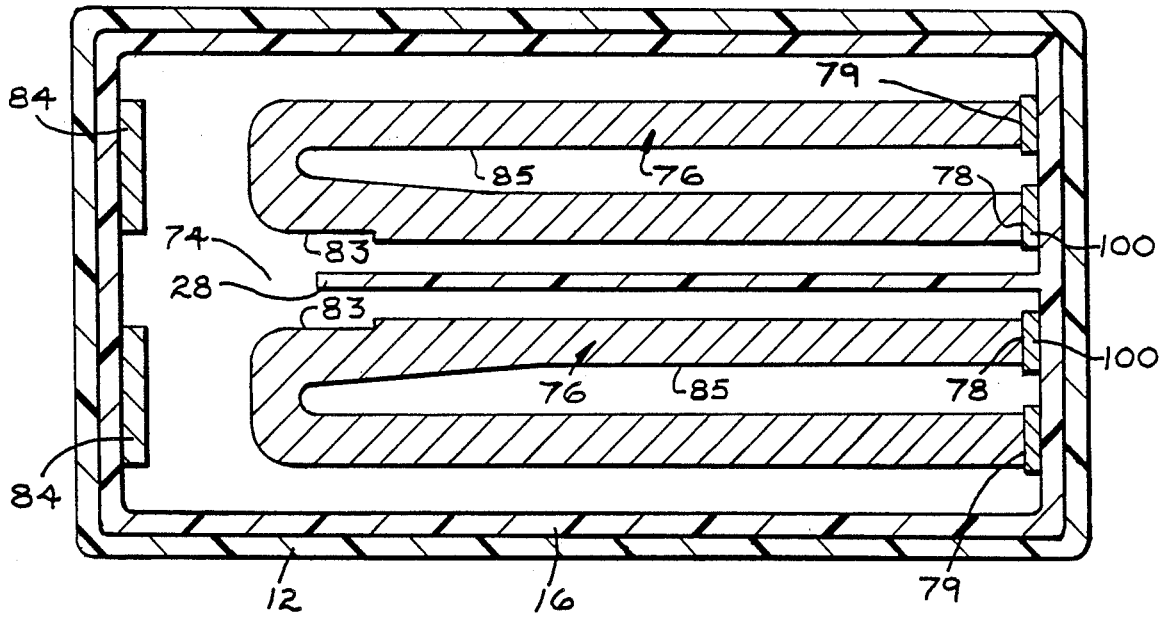
FIG. 7 is a sectional plan view illustrating the bimetal metal thermal actuators as taken along Section VII—VII of FIG. 5.

The thermal actuators are best shown in FIG. 7, are mirror images of each other and are generally represented at 76, and each consist of a U-shaped bi-metal cantilever component formed of a conducting material having a known electrical resistance through which the current being controlled passes. As appreciated from FIGS. 1, 2 and 7 one of the fixed ends 78 of the thermal actuators are connected to the terminals 100 and the other actuator end 79 is electrically connected to the extensions 81. The outer end of the thermal actuators 76 engage the "underside" of the cylindrical head 72 of the lock lever arm 70, on opposite sides of the barrier wall 28. Accordingly, when excessively high currents are passing through the circuit breaker system the temperature of the bimetal actuators 76 will rise and cause an upward movement, FIG. 1, of the free end of the thermal actuator elements raising the free end of the lock lever arm 70 and causing the lock lever 62 to pivot so as to remove the lock lever arm 68 from the bell crank operator notch 60.

From FIG. 7 it will be noted that the free ends of the actuators 76 are notched at 83 adjacent the barrier opening 74 and the purpose of the notches 83 is to increase the spacing between the actuators at the opening 74 to prevent arcing through the opening. The slot 85 between the legs of a common actuator 76 is inclined adjacent the base to equalize the thickness of the legs because of the notches 83.

A fixed contact 82 is mounted upon the terminal 84 on each side of the barrier 28 in electrical communication with the circuit breaker circuitry, and each of the fixed contacts 82 is adapted to be selectively engaged by a movable contact 86. The movable contacts 86 are each mounted upon the free end of a leaf spring 88 which are of a generally U-configuration having a short leg 90, a long leg 92, and an interconnecting concave-convex base 94 of a generally semicylindrical configuration. The short leg 90 is wrapped about and welded to a terminal extension 81 connected to the end 79 of the thermal actuators 76 and the spring base 94 merges into the leaf spring long leg 92 having the free end 98 upon which the movable contact 86 is mounted.

As will be recognized from the drawings, the length of contact spring leg 92 is relatively short, i.e. less that one half the distance separating the housing end walls 14, and accordingly, the contacts 86 will move through an arcuate path of relatively limited radius during operation. A lip 93 acts as an arc shield with respect to the adjacent contact spring.

Figure 2:
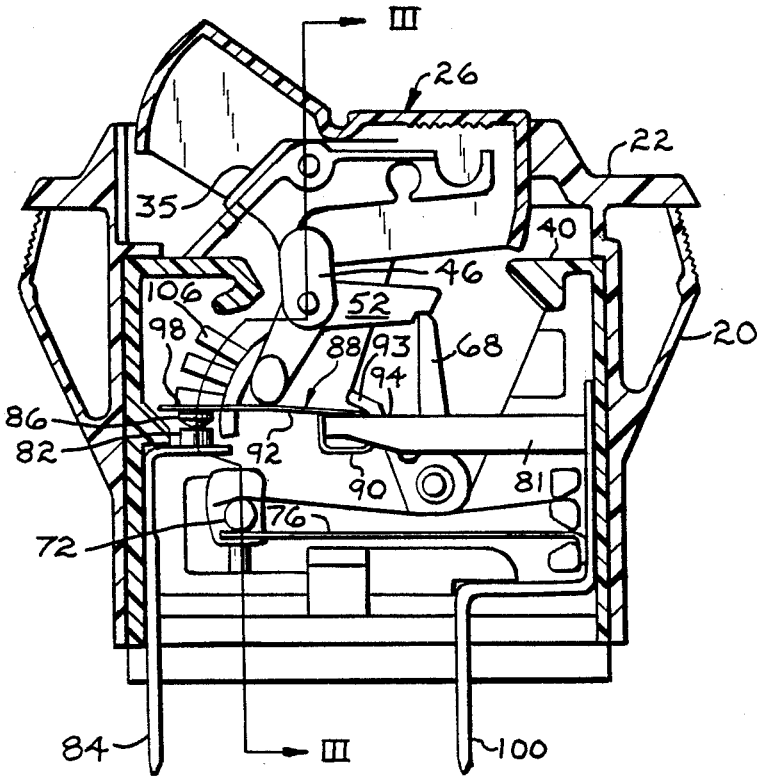
FIG. 2 is an elevational sectional view of the opposite side of the circuit breaker as compared to FIG. 1 as taken along Section II—II of FIG. 3, the contacts being shown in the closed position.

At best illustrated in FIGS. 1, 2 and 3, a plurality of arc creepage path extenders 104 are defined in the barrier wall 28 adjacent the path of movement of the contacts 86. The arc extenders consist of a plurality of recesses 106 formed in the sides of the barrier 28 and these recesses each have a rectangular transverse cross section as will be appreciated from FIG. 3. Also, the recesss 106 are located in an arcuate path with respect to each other, FIG. 2, corresponding to the arcuate path of movement of the adjacent spring contact 86. The presence of the recesses 106 increases the surface length along the side of the barrier wall 28 adjacent the movable contacts and, accordingly, reduces the likelihood of an arc traveling along the barrier side as the contacts are separated.

The lock lever head 72 is biased downwardly by the leaf spring 108 which has a fixed end 110 connected to the inner housing by studs 80 and a free end 112 which engages the "upper" side of the lock lever arm head 72. The leaf spring central region passes under, and is forced downwardly by, the barrier portion defining the bore 66, and in this manner the lock lever 62 is biased counterclockwise, FIG. 2.

The conventional terminals 86 and 100 are in pairs and extend from the innermost portion of the inner housing for plugging into the circuit being controlled, not shown, and it will be appreciated from the above descriptions that the terminals appropriately electrically connect to the thermal actuators 76, the fixed contacts 82 and the springs 88 to permit the circuit breaker to control the flow of current through the circuit being controlled.

In view of the relative sliding movement between the lock lever arm 68 and the bell crank operator notch 60, and the sliding movement of the operator head 58 on the leaf spring leg 92 the lock lever 62 and bell crank operator 52 are preferably formed of a synthetic plastic material having self lubricating qualities wherein any necessity for adding a lubricant to mutual engaging surfaces is eliminated along with the possibility of contact contamination supplemental lubricants create.

In operation, the manual actuator 26 will normally be in the position shown in FIGS. 1 and 2 wherein the surface 32 has been depressed and the rotation of the actuator about its pivot pin 30 would be limited by engagement of the actuator end with the inner housing surface 40. It is to be appreciated that the axes of the pivots 30, studs 44 and 48 are parallel, and when pivoting the actuator 26 to the position of FIGS. 1 and 2 the axis 44 of the over-center links 46 will pass through the plane in which the axes of pivot pins 30 and 48 lie and this "over-center" relationship of the pivots 44 will maintain and lock the actuator, links 46 and bell crank lever operator 52 in the illustrated position of FIGS. 1 and 2 even though the actuator leaf spring 35 is tending to rotate the actuator into the contact open position. However, as the biasing force placed upon the bell crank operator 52 by the leaf spring 88 is greater than that being imposed upon the actuator 26 by spring 35 the contact closed position of the circuit breaker would be maintained.

In the circuit closed positions of FIGS. 1 and 2 the thermal actuator 76 will be in its normal condition as excessive current is not present, and the end of the lock lever arm 68 will be engaging the bell crank operator notch 60, and simultaneously, the head 58 located on the operator arm 56 will be engaging the adjacent leaf spring leg 92 forcing the associated contact 86 into an engaging relationship with the fixed contact 82 permitting current flow through the contacts and the spring and the terminals 84 and 100.

The components, under normal conditions, will remain as shown in FIGS. 1 and 2. However, in the event of excessive current load the thermal actuators 76 will be heated causing the thermal actuator free ends to displace the head 72 defined on the lock lever arm 70 pivoting the lock lever 62 in the direction removing the end of the lock lever arm 68 from the bell crank operator notch 60. This action permits the bell crank 52 to rotate in a clockwise direction, FIG. 2, and the spring leg 92 will quickly lift separating the contacts 82 and 86 and the manual actuator spring 35 will pivot the actuator 26 to the position shown in FIG. 5. During this separation of the contact 82 and 84 arcing along the adjacent side of the barrier 28 is discouraged by the presence of the path extender recesses 106.

Figure 5:
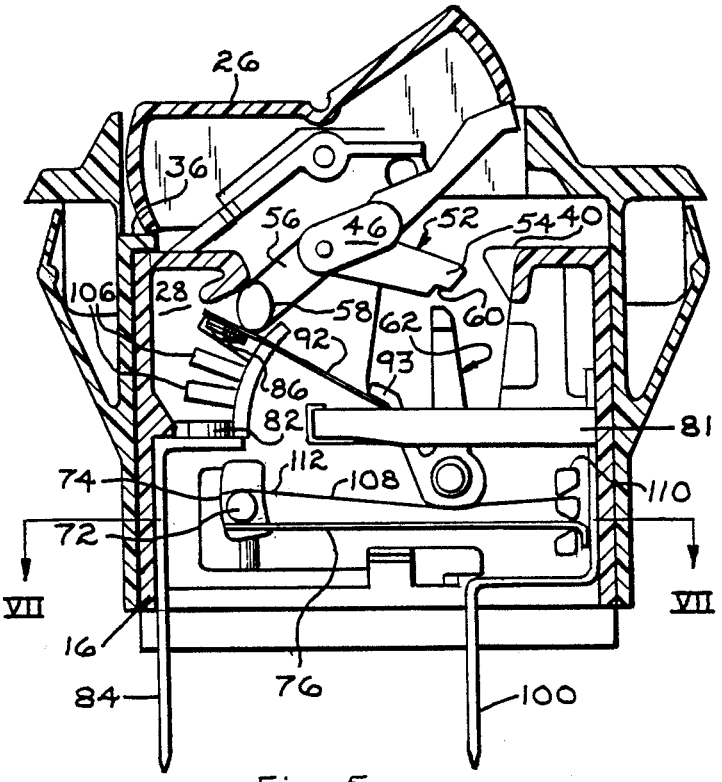
FIG. 5 is an elevational sectional view of the circuit breaker as taken along Section II—II of FIG. 3, the circuit components being shown in the normal open condition.

To reset the circuit breaker the actuator surface 32 is manually depressed which will rotate the actuator from the position of FIG. 5 to the position of FIGS. 1 and 2. This movement will again pass the axis 44 of the over-center link pivot through the plane of the pivots 30 and 48, depress spring leg 92 to engage contacts 86 and 82 and, assuming that the thermal actuators 76 have sufficiently cooled to permit the end of lock lever arm 68 to engage the notch 60 the bell crank operator 52 will maintain the relationship shown in FIGS. 1 and 2 restoring the circuit breaker to normal operation.

Figure 6:
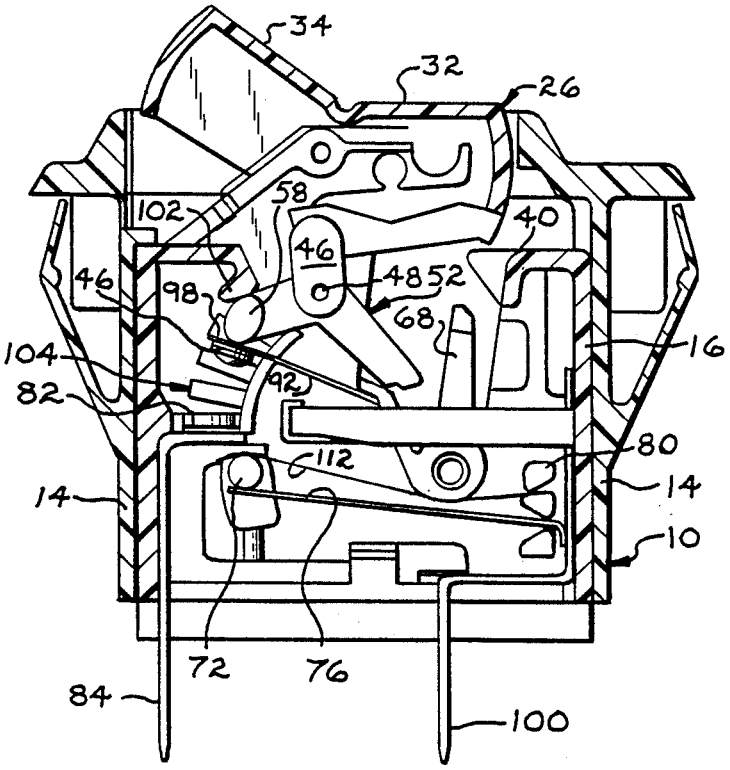
FIG. 6 is an elevational sectional view as taken along Section II—II of FIG. 3, the components being illustrated in the circuit open condition when the manual actuator is positioned to the "circuit closed trip free" position.

The circuit of the invention will open under excess current conditions even if the manual actuator 26 is physically held, or pushed, to the circuit closed condition, and this relationship is shown in FIG. 6. In such instance, the thermal actuators 76 will have rotated to the "trip" condition shown in FIG. 6 disengaging the lock lever arm 68 from the bell crank notch 60, and this release of the bell crank arm will permit the bell crank to rotate in a clockwise direction under the influence of the biasing force of the spring leg 92 disengaging the contacts 82 and 86 and permitting the bell crank head 58 to pivot upwardly until the stop lip 102 is engaged. Under the conditions of FIG. 6, while the contacts 82 and 86 will not be separated quite as fully as in the normal circuit open condition of FIG. 5, the contact separation is sufficient to prevent arcing, and this contact separation is considerably greater that with most circuit breakers under such conditions and is possible because of the use of the bell crank configuration of the operator 52.

The utilization of the over-center links 46, and the employment of the bell crank control operator 52 provide a positive control of the contact leaf spring 88 in a concise configuration, and the use of the barrier 28 to separate conducting components, the notches 83, the short length of the contact springs 88 and the wide separation between the extensions 81, and the arc path extenders 104 all contribute to the preventing of "arc over" between conductors and these features provide important distinctions over other concise circuit breaker constructions. The configuration and relationships of the aforementioned anti-arcing constructions and the configured barrier slots and other components permit a concise circuit breaker constructed in accord with the invention to qualify for the Underwriter Labortory 107 Class A standards, and the disclosed construction simplifies assembly and renders efficient use of the mechanical features of the disclosed components. It is appreciated that various modifications to the inventive concepts may be apparent to those skilled in the art without departing from the sphere and scope of the invention, and in the claims the outer and inner housings are considered to constitute a unitary component.

I claim:

1. A circuit breaker characterized by its ability to control relatively high electrical loads in a concise size and configuration comprising, in combination, a housing having an access side, an actuator mounted on said housing at said access side pivotal about a first pivot axis for movement between first and second positions, stop means defined on said housing limiting pivotal movement of said actuator at said positions, an over-center link pivotally mounted upon said actuator about a second axis, a bell crank control operator pivotally mounted on said link about a third axis, said first, second and third axes being substantially parallel, said bell crank operator including a first contact spring engagable arm and a second lock lever engagable arm angularly related to said first arm, a lock lever pivotally mounted on said housing having a first arm selectively engagable with said operator second arm and a second arm selectively engagable with a thermal actuator, a thermal actuator within said housing displacable between normal and excess current positions and engagable with said lock lever second arm when in said excess current position, a fixed electrical contact defined in said housing, a resilient deflectable contact spring mounted in said housing having a free end selectively movable toward said fixed contact and a normal resilient bias away from said fixed contact, a second electrical contact mounted on said spring free end for selective engagement with said fixed contact, terminals defined on said housing in electrical communication with said contacts and said thermal actuator, said operator first arm engaging said contact spring to deflect said spring free end toward said first contact to cause said second contact to engage said first contact when said actuator is in its second position and said lock lever first arm is engaged by said operator second arm, pivoting of said actuator to its second position translating said second axis through the common plane in which said first and third axes lie to maintain said actuator in its said second position.

2. A circuit breaker as in claim 1 wherein, said contact spring has an effective pivotal length, and said effective pivotal length is approximately one half the dimension of said housing in a direction substantially perpendicular to the length of said axes.

3. In a circuit breaker as in claim 2, said contact spring being of a generally U-shape configuration having a short leg, a long leg defining said free end, and a reversing base, means fixing said contact spring short leg to one of said terminals, and said base defining a pivot for said long leg.

4. In a circuit breaker as in claim 1, an insulating dielectric barrier defined in said housing substantially perpendicular to the length of said axes and substantially centrally located within said housing, first and second sets of fixed contacts, resilient deflectable contact springs and second electrical contacts defined within said housing, said first set being located upon one side of said barrier and said second set being located upon the other barrier side, said barrier having a first side disposed toward said first set of contacts and a second side disposed toward said second set of contacts, and arc path extender means defined in said barrier sides adjacent said first and second sets of contacts, respectively, to minimize arc movement along said baffle sides when said contacts of a set are open.

5. In a circuit breaker as in claim 4, said arc path extenders each comprising a plurality of spaced recesses defined in the associated barrier side, said recesses each having a substantially rectangular transverse cross sectional configuration.

6. In a circuit breaker as in claim 5, each of said contact spring free ends moving through an arcuate configuration as the associated second contact is moved between open and closed positions with respect to said first contact, said arc extender recesses defined on said barrier sides being related to each other in an arcuate configuration substantially corresponding to the arcuate movement of said second contacts.

7. In a circuit breaker as in claim 1, said bell crank operator arms defining an included angle with respect to each other of approximately 120 degrees.

8. In a circuit breaker as in claim 1, said bell crank operator and said lock lever each being formed of self lubricating synthetic plastic material.

9. In a circuit breaker as in claim 5, an opening defined in said barrier, the outer end of said lock lever second arm including a portion extending through said barrier opening, said barrier opening being of a circular configuration concentric to the pivot axis of said lock lever to minimize the size of said opening while accomodating movement of said lock lever second arm end.

10. In a circuit breaker as in claim 7, said bell crank second arm pivoting toward said contact spring upon said second arm disengaging from said lock lever first arm due to excess current flow permitting said bell crank first arm to pivot away from said contact spring to permit said first and second contacts to fully separate even if said actuator is in its second position.

11. In a circuit breaker as in claim 1, an insulating dielectric barrier defined in said housing substantially perpendicular to the length of said axes and substantially centrally located within said housing, first and second sets of fixed contacts, resilient deflectable contact springs and second electrical contacts defined within said housing, said first set being located upon one side of said barrier and said second set being located upon the other barrier side, said barrier having a first side disposed toward said first set of contacts and a second side disposed toward said second set of contacts, said thermal actuator comprising a pair of electrical conducting bi-metal cantilever supported elements each having an end fixed with respect to said housing and a displaceable free end operatively engageable with said lock lever second arm, said elements being located on opposite sides of said barrier, an opening defined in said barrier adjacent said elements, free end, and a notch defined in said free end of each element disposed toward said barrier wall, said notches increasing the distance between said elements through said barrier opening.

* * * * *